United States Patent [19]

Pritchett

[11] 4,048,971

[45] Sept. 20, 1977

[54] FUEL INJECTION SYSTEM

[76] Inventor: Donald H. Pritchett, 17 Rosewood, Rte. 2, Collinsville, Ill. 62234

[21] Appl. No.: 677,507

[22] Filed: Apr. 15, 1976

[51] Int. Cl.[2] ..... F02M 39/00

[52] U.S. Cl. ..... 123/139 R; 123/139 AJ

[58] Field of Search ..... 123/139 R, 139 AJ, 32 VN

[56] References Cited

U.S. PATENT DOCUMENTS

| | | | |
|---|---|---|---|
| 2,799,535 | 7/1957 | French | 123/139 AJ |
| 2,846,987 | 8/1958 | Nehel | 123/139 R |
| 2,986,134 | 5/1961 | Bernard | 123/139 AJ |

*Primary Examiner*—Carroll B. Dority, Jr.
*Assistant Examiner*—Ronald B. Cox
*Attorney, Agent, or Firm*—Cohn, Powell & Hind

[57] ABSTRACT

A fuel injection system for an internal combustion engine in which a ram is fixed to and movable with a piston reciprocatively mounted in the cylinder, the ram being provided with a fuel compression chamber having a fuel injection port communicating with the cylinder. A stem is telescopically and slidably related to the ram. Fuel is introduced into the ram chamber under suction pressure in the ram chamber as the ram and stem are relatively extended when the ram moves with the piston in one direction in the cylinder, and the fuel is compressed in the ram chamber between the ram and stem as the ram and stem are relatively retracted when the ram moves with the piston in the other direction in the cylinder, the compressed fuel being ejected at a predetermined pressure through the injection port and into the cylinder. A first valve is provided in the ram which is normally closed to preclude flow through the injection port, and a second valve is located in the tubular stem and interconnects the stem and ram chamber. A fuel inlet introduces fuel into the tubular stem at one side of the second valve. An actuator is connected to the second valve for opening the second valve and permitting flow from the stem into the ram chamber, the first valve opening at the predetermining pressure to eject the compressed fuel in the ram chamber through the injection port. The first valve includes a check valve element. The second valve includes a second valve element, and a second valve rod connected to the second valve element and extending in the stem. The actuator includes a plunger engaging the valve rod for moving the second valve element to the open position.

5 Claims, 1 Drawing Figure

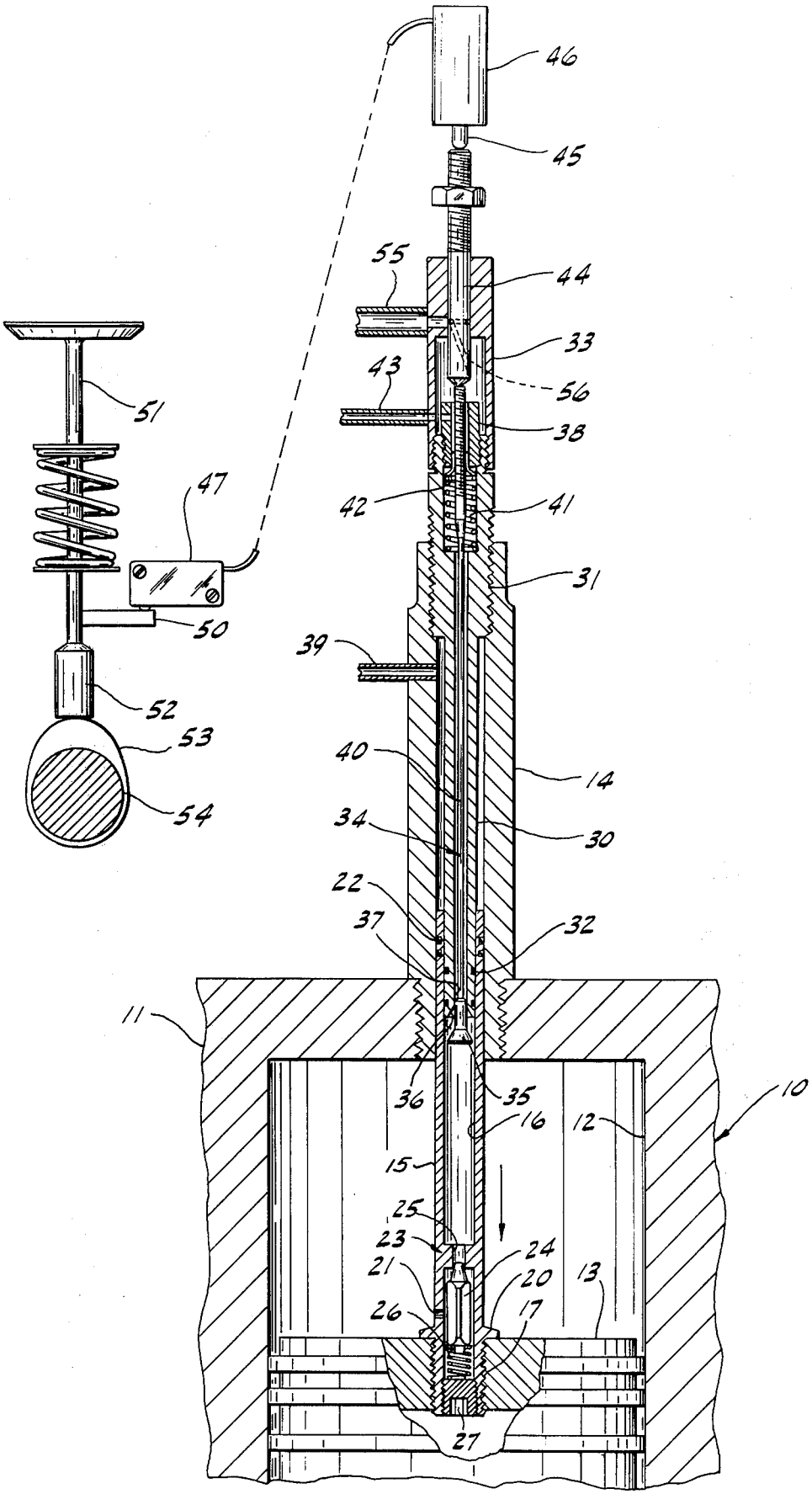
46
45
55
44
33
43
56
38
51
47
42
41
31
50
39
52
53
40
14
54
34
30
22
37
32
11
36
35
10
16
12
15
25
23
24
21
20
13
26
17
27

FUEL INJECTION SYSTEM

BACKGROUND OF THE INVENTION

This invention relates generally to improvements in a fuel injection system for an internal combustion engine, and more particularly to a fuel injection system in which a component part that injects the fuel into the cylinder is directly attached to and movable with the piston.

In prior fuel injection systems, the fuel was injected into the cylinder by a jet nozzle or port that was carried by the engine head and communicated with the cylinder. The metering of the fuel for injection, the pump, and the means for timing the injection of the fuel was accomplished by mechanism entirely seprate structurally from the piston.

SUMMARY OF THE INVENTION

It is important to provide the fuel injection pump and fuel injection port in a single unit that is directly connected to and operated by the piston.

The present invention relates to a fuel injection system for an internal combustion engine in which a ram is fixed to and is movable with a piston reciprocatively mounted in the cylinder, the ram being provided with a fuel compression chamber having a fuel injection port communicating with the cylinder. A stem is telescopically and slidably related to the ram. Means is provided for introducing fuel into the ram chamber under suction pressure in the ram chamber as the ram and stem are relatively extended when the ram moves with the piston in one direction in the cylinder, and for compressing the fuel in the ram chamber between the ram and stem as the ram and stem are relatively retracted when the ram moves with the piston in the other direction in the cylinder. The compressed fuel in the ram chamber is ejected at a predetermined pressure through the injection port and into the cylinder.

A first valve means is provided in the ram which is normally closed to preclude flow through the injection port. A second valve means is located in the tubular stem and interconnects the stem and ram chamber. A fuel inlet introduces fuel into the tubular stem at one side of the second valve means. An actuating means is connected to the second valve means for opening the second valve means and permitting fuel to flow from the tubular stem into the ram chamber under suction pressure as the ram and stem are relatively extended, and for closing the second valve means and compressing the fuel in the ram chamber between the first valve means and the second valve means as the ram and stem are relatively retracted. The first valve means opens at the predetermined pressure to eject the compressed fuel in the ram chamber through the injection port and into the cylinder.

More particularly, the first valve means includes a check valve element that opens at the predetermined pressure in the ram chamber. The second valve means includes a second valve element movable to an open or closed position, and a second valve rod connected to the second valve element and extending in the stem. The fuel in the ram chamber is compressed between the check valve element and the second valve element.

The tubular stem is fixed to and is located in a tubular body that is fixed to the engine head, the body, stem and ram forming a compact unit.

In the fuel injection system, the tubular body is fixed to the head, and the tubular ram which is fixed to and movable with the piston, is slidingly and sealingly mounted in the tubular body. The tubular stem which is fixed to the tubular body, is slidably and sealably mounted in the ram for relative telescopic and extension and retraction. The second valve means in the tubular stem and interconnecting the stem and ram includes a second valve element movable to an open or closed position, a second valve rod connected to the second valve element and extending in the stem, and resilient means tending to urge the second valve element toward the closed position. A plunger is engageable with the valve rod for moving the second valve element to an open position and permitting fuel to flow from the stem into the ram chamber as the ram and stem are relatively extended when the ram moves with the piston toward its bottom dead center position in the cylinder, and the plunger enabling movement of the second valve element under loading of the resilient means to a closed position for compressing the fuel in the ram chamber between the check valve in the ram and the second valve element in the stem as the ram and stem are relatively extracted when the ram moves with the piston toward it stop dead center position in the cylinder.

The present fuel injection system will achieve a considerable saying in fuel used and a much cooler-operating engine than that obtained by the heretofore conventional engines using the present well-known carburetors.

BRIEF DESCRIPTION OF THE DRAWING

FIG. 1 is a longitudinal cross sectional view of the fuel injection system together with a schematic indicating certain operating operating component parts.

DESCRIPTION OF THE PREFERRED EMBODIMENT

Referring now by characters of reference to the drawing, it will be understood that the internal combustion engine generally indicated by 10 includes a head 11, and a cylinder 12 in which a piston 13 is reciprocatively mounted in the conventional manner.

The fuel injection system includes a tubular body 14 threadedly attached to the engine head 11 and axially aligned with the cylinder 12 and piston 13. Fixed to and movable with the piston 13 is a tubular ram 15. As will appear from later detailed description of parts, the ram 15 is provided with an internal fuel compression chamber 16. More particularly, the ram 15 includes a threaded end 17 threadedly attached to the top of piston 13, and includes an annular flange 20 that engages the top face of the piston 13 and locates the ram 15. Formed in the ram 15 immediately above the annular flange 20 is a fuel injection port 21. The other end of ram 15 is slidably and sealably mounted within the tubular body 14 for reciprocative movement as the ram 15 is moved with the piston 13. Seals 22 are carried by the ram 15 and engage the internal surface of the tubular body 14.

Provided in the ram 15 is a first valve means referred to by 23. The first valve means 23 includes a check valve element 24 which normally closes a first valve port 25 at one side of the fuel compression chamber 16 to preclude flow through the fuel injection port 21. A compression spring 26 between a set screw 27 in the threaded end 27 of ram 15 and the check valve element 24, tends to urge the check valve element 24 toward its closed position. The loading of the spring 26 will predetermine the pressure in the chamber 16 at which the check valve element 24 will open.

An elongate tubular stem 30 includes a relatively enlarged threaded portion 31 that is threadedly attached to the top of the tubular body 14, the stem 30 extending longitudinally along the body 14. The lower end of the stem 30 is slidably and sealably mounted in the ram 15 for relative telescopic extension and retraction. Seals 32 are carried by the lower end of the stem 30 and engage the internal surface of the ram 15. The tubular stem includes a cap 33 that is threadedly attached to the upper enlarged portion 31.

A second valve means generally indicated by 34 includes a second valve element 35 engageable with a second valve seat 36 at the end of the tubular stem 30 to close a second valve port 37 that communicates the tubular stem 30 with the fuel compression chamber 16 of the tubular ram 15. A second valve rod 40 is attached to the second valve element 35 and extends longitudinally in the tubular stem 30 to project into the cap 33. A compression spring 41, constituting a resilient means, is located in the tubular stem about the second valve rod 40, and engages a washer 42 threadedly attached to the second valve rod 40, thereby tending to move the second valve element 35 toward a closed position. The spring pressure on the rod 40 can be adjusted by washer 42. A bushing 38 locks the washer 42 in adjusted position and serves as a guide for rod 40.

A fuel inlet 43 communicates with the interior of the cap 33, and hence communicates with the interior of the tubular stem 30 at one side of the second valve element 35.

An oil inlet 39 communicates with the tubular body 14 between the stem 30 and the ram 15, the oil inlet 39 passing oil into and out of the body 14 under the reciprocative action of the ram 15. The oil inlet 39 connects to an oil reservoir (not shown). The oil lubricates and cools the unit.

The actuating means includes a timing plunger 44 reciprocatively mounted in the top of cap 33, the timing plunger 44 engaging the top of the second valve rod 40. The plunger 45 of an electric solenoid 46 operatively engages the top of the timing plunger 44, the solenoid 46 being electrically connected to a micro-switch 47.

The micro-switch 47 is engageable and actuated by an arm 50 attached to and movable with the air-intake valve 51. As is conventional, the air-intake valve 51 engages a valve lifter 52 that rides on the timing cam 53 of a timing cam shaft 54.

A fuel vent 55 is attached to the cap 33 and communicates with the fuel inlet 43 and the tubular stem 30 through a passageway 56 formed in the timing plunger 44. It will be understood that the passage 56 is aligned with the fuel vent 55 only when the timing plunger 44 is depressed upon actuation of the solenoid 46.

It is thought that the operation of the fuel injection system is apparent from the foregoing detailed description of parts, but for a complete disclosure, such operation will be briefly described.

As is conventional, the piston 13 is connected to the usual type of crankshaft and reciprocates in the cylinder 12 between a top dead center position and a bottom dead center position. It will be assumed that the piston 13 is moving downwardly in the cylinder 12 from its top dead center position.

As the piston 13 moves downwardly, the ram 15 which is attached to the piston 13, moves downwardly also, thereby causing a relative extension of the telescopically related ram 15 and stem 30. As the piston 13 moves downwardly, the timing cam 53 lifts the air intake valve 51 and causes an intake of air into the cylinder 12. At the same time, the valve arm 50 engages the micro-switch 47 to actuate the solenoid 46, and thereby causes the solenoid plunger 45 to depress the timing plunger 44 sufficiently to open the second valve means 34. In other words, the timing plunger 44 depresses the second valve rod 40 to unseat the second valve element 35 so as to open the second valve port 37, thereby allowing fuel which has entered the tubular stem 30 through the fuel inlet 43 to flow into the fuel compression chamber 16 of ram 15 under suction pressure in the ram chamber 16 created by the relative extension of the ram 15 and stem 30.

When the timing plunger 44 is depressed to open the second valve element 35, the plunger passage 56 places the fuel vent 55 in communication with the fuel inlet 43 and the tubular stem 30. As a result, fuel from the tubular stem flows more freely through the second valve port 37 from the stem 30 into the ram chamber 16.

When the piston 13 reaches its bottom dead center position in the cylinder 12, the air intake valve 51 is closed under the action of the timing cam 53. The micro-switch 47 is disengaged by the valve arm 50 so as to de-energize the solenoid 46, thereby permitting the compression spring 41 to raise the second valve element 35 to its closed position. It will be understood that at this stage of the cycle, the check valve 24 and the second valve element 35 are both closed and that a quantity of fuel is now contained in the fuel compression chamber 16 of the ram between the check valve 24 and the second valve element 35.

When the piston 13 moves upwardly from its bottom dead center position, the fuel in the ram chamber 16 is compressed between the check valve 24 and the second valve element 35 as the ram 15 and stem 30 are relatively retracted. As the piston 13 reaches its top dead center position, the check valve 24 will open at a predetermined pressure in the ram chamber 16, thereby causing the compressed fuel in the ram chamber 16 to be ejected through the fuel injection port 21 and into the cylinder 12. When a sufficient compression pressure is reached in the cylinder 12 at the top of the piston 13, the fuel-air mixture in the cylinder 12 will ignite. Of course, it will be understood that the ignition of the fuel-air mixture can be also obtained by the use of the conventional spark plug. After the fuel has been ejected through the fuel injection port 21, the check valve 24 will close.

Combustion in the cylinder 12 will then drive the piston 13 downwardly from its top dead center position toward its bottom dead center position for its drive stroke. As the ram 15 and tubular stem 30 are relatively extended during the drive stroke of piston 13, both the check valve 24 and the second valve element 35 will remain closed. The air-intake valve 51 will remain closed and therefore the solenoid 46 will remain de-energized. Consequently, there is no fuel introduced from the tubular stem 30 into the fuel compression ram chamber 16.

Upon completion of the drive stroke, the piston 13 will then move from its bottom dead center position back toward its top dead center position. It will be understood that there is no fuel in the ram chamber 16, and therefore there is no fuel injection into the cylinder 12 as the piston 13 approaches its top dead center position. As the piston 13 moves upwardly, the usual exhaust valve (not shown) is opened to discharge the spent gases in the cylinder 12. As the piston 13 approaches its top dead center position, this exhaust valve (not shown) will be closed so that if there is any residual fuel inside the ram 15 and ejected through the fuel injection port 21 into the cylinder 12 at that time, it will be mixed with the regular air intake as the piston 13 moves back downwardly and the air-intake valve 51 is opened to start the next cycle of operation.

It will be importantly understood that fuel is injected into the cylinder 12 only at the top dead center position of the piston 13 which results in a considerable fuel economy over the heretofore conventional fuel injection systems in which fuel is injected into the cylinder 12 from the time the intake valve opens until it closes.

I claim as my invention:

1. In a fuel injection system for an internal combustion engine having a head and a cylinder, and having a piston reciprocatively mounted in the cylinder:

a. a ram fixed to and movable with the piston, the ram being provided with a fuel compression chamber having a fuel injection port communicating with the cylinder, b. a first valve means in the ram normally closed to preclude flow through the injection port, c. a tubular stem telescopically and slidably related to the ram, d. a second valve means located in the tubular stem and interconnecting the tubular stem and ram chamber for regulating fuel flow therebetween, e. a fuel inlet means for introducing fuel into the tubular stem at one side of the second valve means, f. actuating means operatively connected to the second valve means for opening the second valve means every second expansion of the ram chamber and permitting fuel to flow from the tubular stem into the ram chamber under suction pressure in the ram chamber as the ram and stem are relatively extended when the ram moves with the piston in one direction in the cylinder, and for closing the second valve means and compressing the fuel in the ram chamber between the first valve means and the second valve means as the ram and stem are relatively retracted when the ram moves with the piston in the other direction in the cylinder, and g. the first valve means opening at a predetermined pressure to eject the compressed fuel in the ram chamber through the injection port and into the cylinder.

2. In a fuel injection system for an internal combustion engine having a head and a cylinder, and having a piston reciprocatively mounted in the cylinder:

a. a ram fixed to and movable with the piston, the ram being provided with a fuel compression chamber having a fuel injection port communicating with the cylinder, b. a first valve means in the ram normally closed to preclude flow through the injection port, c. a tubular stem telescopically and slidably related to the ram, d. a second valve means located in the tubular stem and interconnecting the stem and ram chamber, e. a fuel inlet means for introducing fuel into the tubular stem at one side of the second valve means, f. actuating means connected to the second valve means for opening the second valve means and permitting fuel to flow from the tubular stem into the ram chamber under suction pressure in the ram chamber as the ram and stem are relatively extended when the ram moves with the piston in one direction in the cylinder, and for closing the second valve means and compressing the fuel in the ram chamber between the first valve means and the second valve means as the ram and stem are relatively retracted when the ram moves with the piston in the other direction in the cylinder, g. the first valve means opening at a predetermined pressure to eject the compressed fuel in the ram chamber through the injection port and into the cylinder, h. the second valve means including:

1. a second valve element movable to an open or closed position, and 2. a second valve rod connected to the second valve element and extending in the stem, and i. the actuating means including a plunger engaging the valve rod for moving the second valve element to the open position.

3. A fuel injection system as defined in claim 2, in which:

h. the stem is sealingly slidable in the ram, i. the second valve means includes:

1. a second valve seat near the end of the stem, and 2. a second valve element connected to the actuating means for moving the second valve element toward the valve seat to a closed position and away from the valve seat to an open position, and j. the fuel in the ram chamber is compressed between the first valve means and the second valve element when moved to a closed position by the actuating means.

4. In a fuel injection system for an internal combustion engine having a head and a cylinder, and having a piston reciprocatively mounted in the cylinder:

a. a ram fixed to and movable with the piston, the ram being provided with a fuel compression chamber having a fuel injection port communicating with the cylinder, b. a first valve means in the ram normally closed to preclude flow through the injection port, c. a tubular stem telescopically and slidably related to the ram, d. a second valve means located in the tubular stem and interconnecting the stem and ram chamber, e. a fuel inlet means for introducing fuel into the tubular stem at one side of the second valve means, f. actuating means connected to the second valve means for opening the second valve means and permitting fuel to flow from the tubular stem into the ram chamber under suction pressure in the ram chamber as the ram and stem are relatively extended when the ram moves with the piston in one direction in the cylinder, and for closing the second valve means and compressing the fuel in the ram chamber between the first valve means and the second valve means as the ram and stem are relatively retracted when the ram moves with the piston in the other direction in the cylinder, g. the first valve means opening at a predetermined pressure to eject the compressed fuel in the ram chamber through the injection port and into the cylinder, h. a tubular body being fixed to the head, i. the stem being fixed to and located in the tubular body, j. a fuel vent means, and k. the actuating means including a passage connecting the fuel vent means with the tubular stem when the second valve means is opened.

5. In a fuel injection system for an internal combustion engine having a head and a cylinder, and having a piston reciprocatively mounted in the cylinder:

a. a tubular body fixed to the head, b. a tubular ram fixed to and movable with the piston, the ram being provided with a fuel compression chamber having a fuel injection port communicating with the cylinder, and the ram being slidingly and sealingly mounted in the tubular body, c. a check valve in the ram which is normally closed to preclude flow through the fuel injection port and which opens at a predetermined pressure in the ram chamber, d. a tubular stem fixed to the tubular body, and slidably and sealably mounted in the ram for relative telescopic extension and retraction, e. a second valve means in the tubular stem and interconnecting the stem and ram chamber, the second valve means including:

1. a second valve element movable to an open or closed position, 2. a second valve rod connected to the second valve element and extending in the stem, and 3. resilient means tending to move the second valve element toward the closed position, f. a fuel inlet means communicating with the tubular stem at the side of the second valve element opposite the ram chamber, g. actuating means including a plunger engageable with the valve rod for moving the second valve element to an open position and permitting fuel to flow from the stem into the ram chamber under suction pressure in the ram chamber as the ram and stem are relatively extended when the ram moves with the piston toward its bottom dead center position in the cylinder, and the plunger enabling movement of the second valve element under loading of the resilient means to a closed position for compressing fuel in the ram chamber between the check valve and second valve element as the ram and stem are relatively retracted when the ram moves with the piston toward its top dead center position in the cylinder, h. the check valve opening at the predetermined pressure to eject the compressed fuel in the ram chamber through the injection port and into the cylinder, and i. a fuel vent means including a passage in the plunger communicating the fuel vent means with the tubular stem and fuel inlet means when the second valve element is in its open position.

* * * * *